US006442948B1

(12) United States Patent
Takeda

(10) Patent No.: US 6,442,948 B1
(45) Date of Patent: Sep. 3, 2002

(54) LIQUID HELIUM RECONDENSATION DEVICE AND TRANSFER LINE USED THEREFOR

(75) Inventor: Tsunehiro Takeda, Tokyo (JP)

(73) Assignee: Japan Science and Technology Corporation, Saitama-Ken (JP)

( * ) Notice: Subject to any disclaimer, the term of this patent is extended or adjusted under 35 U.S.C. 154(b) by 0 days.

(21) Appl. No.: 09/868,574

(22) PCT Filed: Nov. 30, 1999

(86) PCT No.: PCT/JP99/06683

§ 371 (c)(1),
(2), (4) Date: Jun. 20, 2001

(87) PCT Pub. No.: WO00/39513

PCT Pub. Date: Jul. 6, 2000

(30) Foreign Application Priority Data

Dec. 25, 1998 (JP) ..... 10-369064

(51) Int. Cl.[7] ..... F17C 3/10
(52) U.S. Cl. ..... 62/48.2; 62/48.3
(58) Field of Search ..... 62/608, 47.1, 48.2, 62/48.3, 50.7

(56) References Cited

U.S. PATENT DOCUMENTS 4,055,961 A * 11/1977 Admiraal ..... 62/54
4,277,949 A 7/1981 Longsworth
4,421,537 A * 12/1983 Kuraoka ..... 62/22
4,790,147 A 12/1988 Kuriyama et al.
5,782,095 A * 7/1998 Chen ..... 62/47.1

FOREIGN PATENT DOCUMENTS

JP 3-70960 3/1991
JP 7-243712 9/1995

OTHER PUBLICATIONS

International Preliminary Examination Report.

* cited by examiner

*Primary Examiner*—Denise L. Esquivel
*Assistant Examiner*—Malik N. Drake
(74) *Attorney, Agent, or Firm*—Rader, Fishman & Grauer, PLLC

(57) ABSTRACT

A liquid helium circulation system capable of recycling helium gas has a liquid helium reservoir 1 and refrigerator 5 where helium gas boil-off recovered from the reservoir is refrigerated and liquefied, and is designed to have the helium gas refrigerated or liquefied with the refrigerator returned to the reservoir. The system is equipped with line 9*c* that supplies high-temperature helium gas heated up inside the liquid helium reservoir to the refrigerator, where the helium gas is made into refrigerated helium gas, and supplies the refrigerated helium gas to the upper part inside the reservoir, lines 9*b* and 9*a* that supply low-temperature helium gas in the vicinity to the surface of liquid helium inside the liquid helium reservoir to the refrigerator, where the low-temperature gas is liquefied, and supply the liquefied helium to the reservoir.

15 Claims, 4 Drawing Sheets

PRIOR ART

LIQUID HELIUM RECONDENSATION DEVICE AND TRANSFER LINE USED THEREFOR

FIELD OF THE INVENTION

This invention relates to a liquid helium circulation system and transfer lines used with the system. More specifically, it relates to a liquid helium circulation system used in a brain magnetism measurement system that condenses helium gas evaporating from its liquid helium reservoir, where a magnetoencephalography is disposed in an extreme low temperature environment, and to the transfer line used with the system that returns the condensed helium back to the liquid helium reservoir. Besides brain magnetism measurement systems, the liquid helium circulation system and transfer lines are also usable with magnetocardiographs and magnetic resonance imaging (MRI) systems, and in studying and evaluating the properties of a variety of materials at extreme low temperatures.

BACKGROUND OF THE INVENTION

Brain magnetism measurement systems to detect magnetic fields generated by human brains are under development. These systems use super-conducting quantum interference devices (SQUIDs) capable of measuring brain activities with a high space-time resolution and without harming the organs. The SQUID operates in a refrigerated state, emerged in a liquid helium filled insulated reservoir.

With most conventional liquid helium reservoirs in those systems, the helium gas evaporating from the reservoir is released into the atmosphere. This waste of helium in large quantity makes the systems economically disadvantageous because helium is so expensive. Moreover, as the liquid helium in the reservoir is consumed, it must be replenished with fresh liquid helium from a commercial cylinder. The replenishment presents problems, for example, the process becomes extremely troublesome, or that outsourcing costs are substantial.

Accordingly, there is movement to develop liquid helium circulation systems, which may recover and condense the helium gas evaporating from the reservoir in its entirety and recirculate it back to the reservoir.

Referring to FIG. 4, described below, is the schematic configuration of a type of such a liquid helium circulation system. A magnetoencephalography is disposed in a liquid helium reservoir 101, a drive pump 102 recovers the helium gas which vaporized from inside reservoir 101; a dryer 103 dehydrates the recovered helium gas, a flow regulating valve 104; a purifier 105; an auxiliary refrigerator 106; a first heat exchanger 107 for auxiliary refrigerator 106; a condensing refrigerator 108 and a condensing heat exchanger 109 of condensing refrigerator 108 are also present. The helium gas is boiled off from the liquid helium reservoir 101 and whose gaseous temperature is raised to about 300' Kelvin N is suctioned with drive pump 102, and sent through dryer 103 and purifier 105 to auxiliary refrigerator 106, where it is cooled down to about 40' K and condensed. The liquid helium is sent to condensing refrigerator 108, where it is further cooled down to about 4' K as it passes condensing heat exchanger 109. Finally, the extreme low temperature liquid helium is supplied to liquid helium reservoir 101 through transfer line 110.

This prototype helium circulation system is basically a system to recover and recycle all the helium gas evaporating from the liquid helium reservoir. Compared with other conventional or similar systems, whose vaporized helium is released into the air or recovered in a gas bag or the like for reprocessing, it consumes a remarkably smaller quantity of helium, promising benefits of economy and efficiency, which has been spurring recent efforts to put to practical use. In addition, the added feature of the new system to reliably refill fresh liquid helium would make maintenance of the measurement system easier as a whole.

Nevertheless, the new circulation system as above-mentioned is not free from necessary improvements as follows:

While liquid helium is an indispensable medium to keep a SQUID in the refrigerated state, a huge amount of electric energy has to be consumed to run the refrigerator to liquify helium gas. In addition, a large volume of water is required to cool the compression pump of the refrigerator. Furthermore, as the liquefied helium is transferred from the refrigerator to the liquid helium reservoir through the transfer line, it is difficult to isolate it completely from high-temperature parts, causing a large portion of it to become vaporized, resulting in a poor transfer rate. Accordingly, the operating cost as well as insulation measures are expensive comparable to that in the case of allowing the gas to escape into the air. An economical version of liquid circulation system overcoming such problems needs to be developed.

With the above-mentioned background considerations, the inventor has developed the idea of this invention from the phenomena that the quantity of heat (enthalpy) required to raise the temperature of helium gas from about 40 K to about 300 K is much higher than the vaporization heat required for the phase change from liquid helium to gaseous helium at about 4° K, and that while the energy required to cool down high-temperature helium to low-temperature helium is moderate, substantial energy is required to liquefy low-temperature helium gas.

Namely, this invention offers a new type of liquid helium circulation system as a solution to the problems conventional circulation systems have had as above-mentioned. With this invention, high-temperature helium gas as high as 300° K boiling off from the liquid helium reservoir is recovered, cooled down to about 40° K a temperature within the easy reach of a refrigerator, and supplied to the upper part in said reservoir. Also, low-temperature helium gas, for example, approximately 10° K, near the surface of liquid helium inside the reservoir is recovered and liquefied at about 4° K and supplied back to the reservoir. In this manner, the inventory of liquid helium inside the reservoir is easily replenished by as much as is lost by evaporation.

DISCLOSURE OF THE INVENTION

In one embodiment, a liquid helium circulation system having a liquid helium reservoir and a refrigerator that cools down and liquefies helium gas evaporating from the reservoir, and being capable of returning refrigerated helium gas or liquefied helium to the reservoir. One line routes the high-temperature helium gas heated from up inside the reservoir to the refrigerator where it is cooled down, and returns the refrigerated helium to the upper part of the reservoir. It is also characteristic of another line to route low-temperature helium gas in the vicinity of the surface of liquid helium inside the reservoir to the refrigerator where it is liquefied, and returns the liquefied helium to the reservoir.

Also, a liquid helium circulation system characteristic of two pipelines, one connecting the refrigerator and the upper part in said reservoir, another that supplies the low-temperature gas to the refrigerator where it is liquefied, and returns the liquefied helium to the reservoir disposed in the same conduit pipe whose periphery is insulated with a vacuum layer.

Also, a liquid helium circulation system characteristic of a triple-pipe construction has a line that supplies liquid helium at the center, another line that supplies low-temperature helium gas to the refrigerator around the central pipe, and an outermost line that supplies helium gas refrigerated by the refrigerator.

Also, a liquid helium circulation system characteristic of three lines has one line that supplies liquid helium, another line that supplies low-temperature helium gas to the refrigerator, and another line that supplies helium gas refrigerated by the refrigerator. All three lines are disposed in parallel with one another.

Also, a liquid helium circulation system characteristic of three lines has each line having its own surrounding vacuum layer.

Also, a liquid helium circulation system characteristic of two lines, one connecting between the refrigerator and the upper part of the reservoir, and another that supplies low-temperature gas to the refrigerator where it is liquefied, and returns the liquefied helium to said reservoir are disposed separately from one another and each one isolated with a vacuum layer.

Also, a liquid helium circulation system characteristic of a structure that enables the liquid helium liquefied by said refrigerator to be surrounded with low-temperature helium gas and thus isolated from high-temperature parts as it is transported to said reservoir.

Also, a liquid helium circulation system characteristic of a feature that makes it possible to liquefy part of said high-temperature helium gas and supplies the liquefied helium to said refrigerator.

Also, a liquid helium circulation system characteristic of a gas-liquid separator that the liquid helium liquefied by said refrigerator passes through as it is supplied to said reservoir.

Also, in a process to recover helium gas boil-off from a liquid helium reservoir, cool down or liquefy said helium gas and return it to the liquid helium reservoir, a liquid helium circulation method characteristic of supplying high-temperature helium gas heated up inside said liquid helium reservoir to a refrigerator, where it is liquefied, and the liquefied helium to the upper part in said reservoir, and also supplying low-temperature helium gas in the vicinity of the surface of the liquid helium inside said liquid helium reservoir to a refrigerator, where it is liquefied, and the liquefied helium to said reservoir.

Also, a liquid helium circulation method to protect said liquid helium, while being supplied to said liquid helium reservoir, with either low-temperature helium gas or refrigerated helium gas from direct contact with high-temperature parts.

Also, a transfer line, characteristic of its construction, consisting of a line that supplies liquid helium, a line that supplies low-temperature helium gas, and a line that supplies refrigerated helium gas of a temperature higher than that of said low-temperature helium, with each line surrounded by a vacuum layer and all lines disposed inside a conduit whose outer surface is insulated with a vacuum layer.

Also, a transfer line having a triple-pipe design consisting of a line that supplies liquid helium at the center, an intermediate line that supplies low temperature helium gas, and an outermost line that supplies refrigerated helium gas of a temperature higher than that of the low-temperature helium gas, with each line surrounded by a vacuum layer.

With the liquid helium circulation system according to this invention, it is possible to minimize liquid helium boil-off from the liquid helium reservoir because the enthalpy of refrigerated helium gas removes a large quantity of heat. Also, cooling helium gas from about 300' K down to about 40' K requires an amount of energy much less compared with that when producing liquid helium of about 4' K by liquefying helium gas of about 40' K. Therefore, compared with conventional systems liquefying the entire volume of helium gas recovered, this system offers outstanding economic benefit by lowering remarkably the amount of energy consumed in liquefying helium gas by shortening the running time of the refrigerator, etc.

Also, this system recovers and liquefies low-temperature helium gas in the vicinity of the surface of liquid helium in the liquid helium reservoir, which greatly helps save the amount of energy needed in the process of liquefying helium gas, leading to a large reduction in operating cost.

Moreover, this system adapts a method for refrigerated helium gas or low-temperature helium gas to flow around the line supplying liquid helium liquefied by the refrigerator. This isolates the line from surrounding high-temperature parts and protects the liquid helium from evaporating as it flows though the line, which minimizes the loss of energy in a helium gas liquefying process and makes this system a more efficient liquid helium circulation system.

BRIEF DESCRIPTION OF THE DRAWING

FIG. 3A is a cross-sectional view along the line 3A—3A of FIG. 2.

PREFERRED EMBODIMENT

Figure 1:
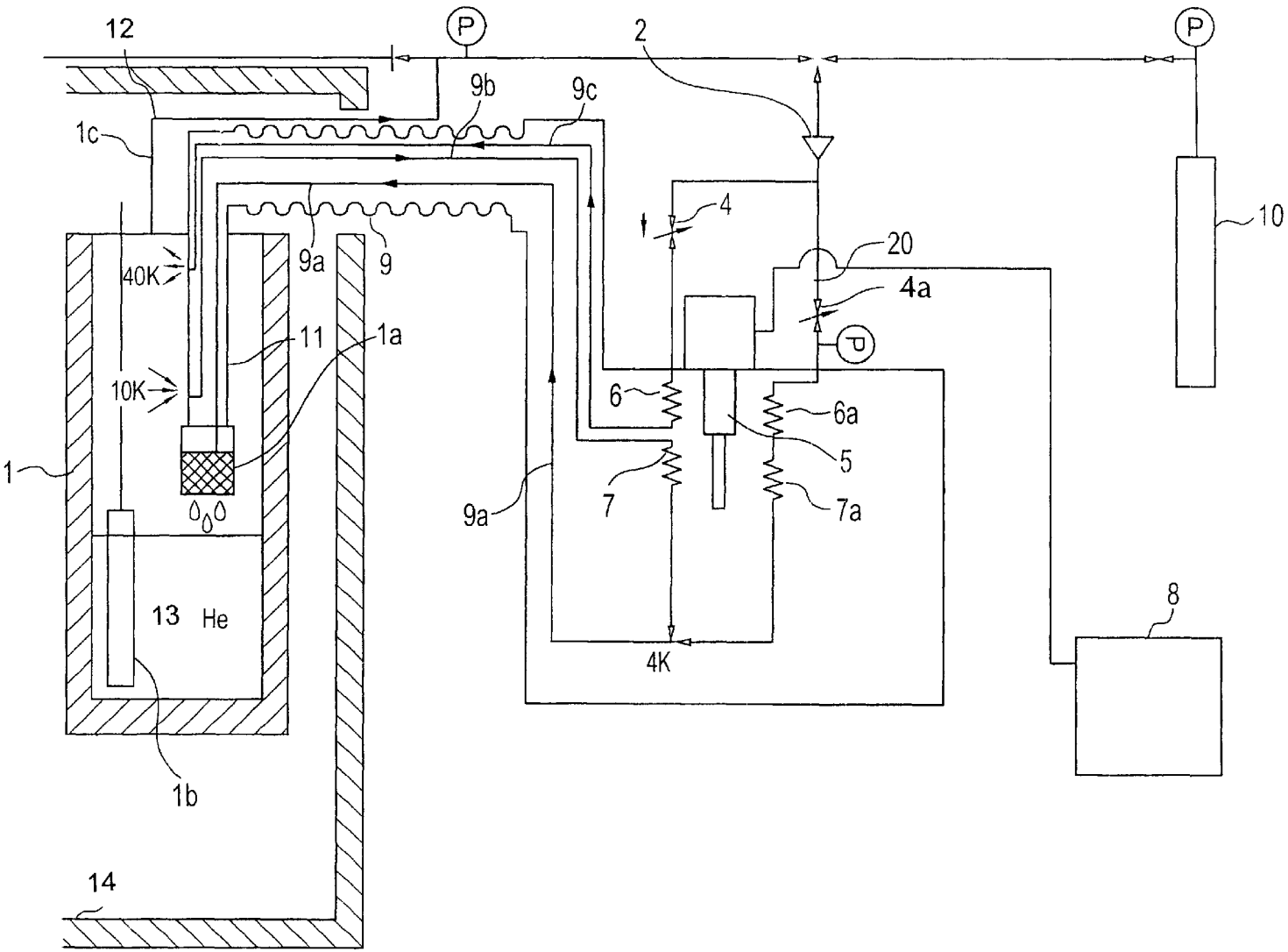
FIG. 1 is a schematic representation of the multi-circulation type liquid helium circulation system according to this invention.

FIG. 1 depicts a schematic of the multi-circulation type liquid helium circulation system according to this invention, the description is given of the system herein below:

A liquid helium reservoir (FRP cryostat) 1 is disposed inside a magnetically-shielded room and wherein a SQUID is placed. A gas-liquid separator 1 a is disposed in the reservoir; A level gauge 1*b* measures the liquid level of liquid helium 13, and a pipe for recovery gas line 12 recovers high-temperature helium gas heated up to about 300° K inside the reservoir. A flow regulating pump 2 supplies recovered high-temperature helium gas to a small capacity refrigerator via pipe 1*c*, connected to a flow regulating valve 4 and a 4 KGM small capacity refrigerator 5 known for its remarkable recent progress. The refrigerator 5 has first and second heat exchangers and third and fourth heat exchangers 6*a*, 7*a*, which liquefy high-temperature helium gas recovered from the reservoir through line 20 in the event the inventory of liquid helium falls short inside the reservoir 1. A 6.5 KW helium compressor 8 and a transfer line 9 with three combined lines, line 9*a* that supplies liquid helium liquefied with refrigerator 5 to liquid helium reservoir 1; line 9*b* that recovers low-temperature helium gas from inside said reservoir 1 and 9*c* that supplies helium gas cooled down to about 40° K by refrigerator 5 to liquid helium reservoir 1. A helium cylinder 10 that supplements a fresh batch of helium in an emergency. An insert pipe 11, connected with transfer line 9 and disposed in liquid helium reservoir 1. Above-mentioned component units are interconnected with each other ensuring that fluids flow in the directions as indicated by arrows. In addition, the magnetic-shield room of FPR cryostat 1 is formed by wall 14.

Figure 2:
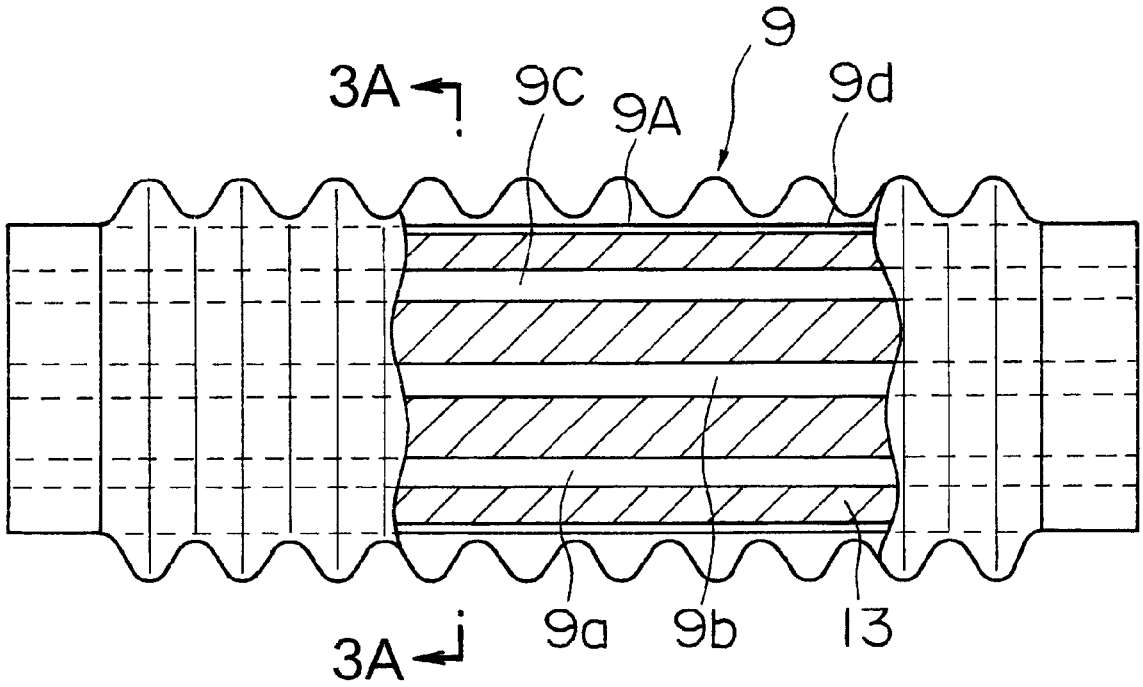
FIG. 2 shows an enlarged side view with a broken section of the transfer line according to this invention.
Figure 3A:
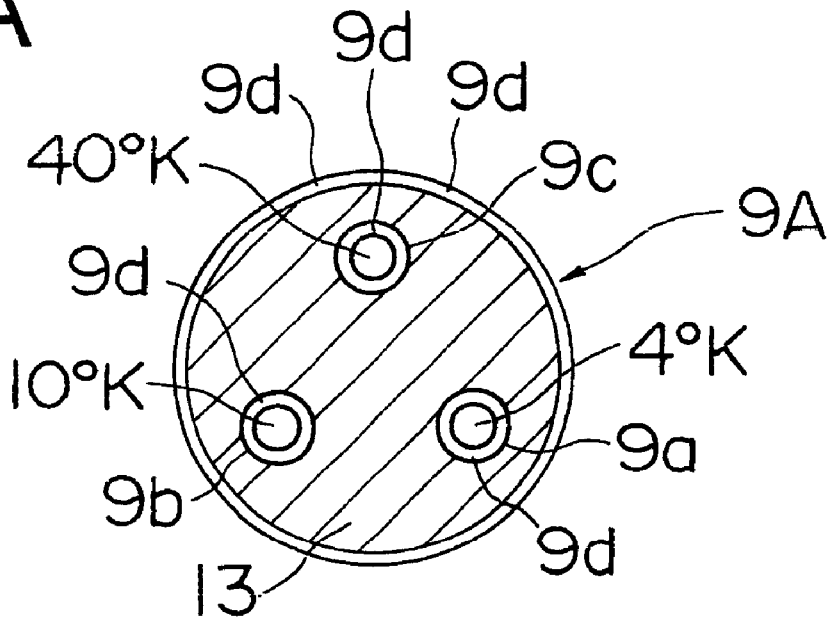
FIGS. 3A and 3B are the cross-sectional drawings of two different configurations of transfer lines.
Figure 3B:
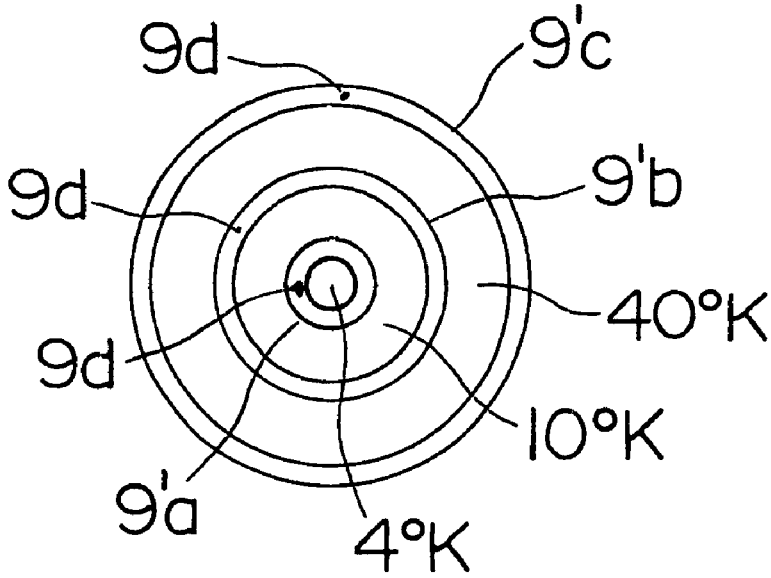
Figure 4:
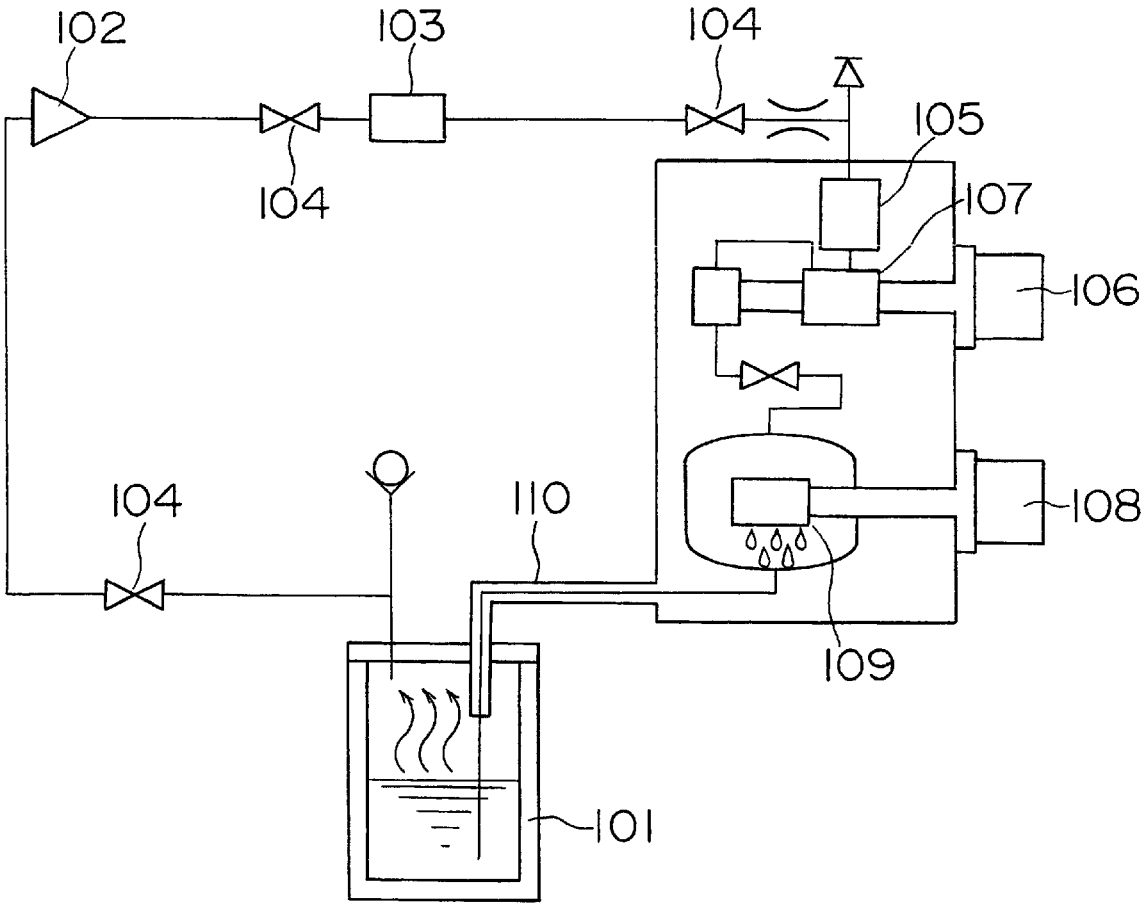
FIG. 4 shows the schematic configuration of a conventional circulation type liquid helium circulation system.

Referring to FIGS. 2, 3A and 3B, the constructions of two different types of transfer lines, among others, are described as follows. FIG. 2 is a side view with a broken section of a transfer line. FIG. 3A is the section along 3A—3A in FIG. 2 and FIG. 3B shows a section of a transfer line of different construction.

The first example of transfer line given in FIG. 3A has pipe 9*a* disposed at the center of a surrounding vacuum layer 9*d* for flowing liquid helium of about 4° K, pipe 9*b* disposed at the center of a surrounding vacuum layer 9*d* for flowing low-temperature helium gas of about 10° K recovered from inside the reservoir, and pipe 9*c* disposed at the center of a surrounding vacuum layer 9*d* for flowing refrigerated helium gas cooled down to about 40° K by the refrigerator. These pipes 9*a*, 9*b* and 9*c* are lined up in parallel with one another and housed in a large pipe 9A with a surrounding vacuum layer 9*d* for insulation and an insulation material 13 installed in its inside.

The second example of transfer line is a triple-pipe version of transfer line 9, consisting of a large pipe 9'*c* surrounded with a vacuum layer 9*d* at the outermost, a medium size pipe 9*b* surrounded with a vacuum layer 9*d* set at the center of pipe 9'*c* and a small pipe 9'*a* surrounded with a vacuum layer set at the center of pipe 9*b*. This triple-pipe construction is designed to allow the flow of refrigerated helium gas of about 40° K along the outer surface of medium size pipe 9'*b*, low-temperature helium gas of about 10° K along the outer surface of small size pipe 9'*a* and liquid helium of about 4° K through the inside of small size pipe 9'*a*.

In the case of example of transfer line of FIG. 3A, three pipes can be bound together, offering an advantage of smaller outer diameter compared with the triple-pipe construction shown in FIG. 3B.

In each case of transfer line 9, the reservoir-side end of the transfer line is connected with an insert pipe 11 disposed in liquid helium reservoir 1, and a gas-liquid separator 1*a* is installed at the end of insert pipe 11. While this gas-liquid separator does not constitute an essential part of this invention, it is desirable to install it where it is necessary to prevent the disturbance of temperature equilibrium in the reservoir due to a paucity of helium gas generating from liquid helium in transit. Of three pipes placed inside transfer line 9, an end of pipe 9*a* that supplies the liquid helium liquefied with the refrigerator to liquid helium reservoir 1 is connected with gas liquid separator 1*a*, an end of pipe 9*b* that recovers low-temperature helium gas from inside reservoir 1 and supplies it to the refrigerator is located close to the gas-liquid separator 1*a* of insert pipe 11 or in the vicinity of the surface of liquid helium inside reservoir 1 so that low temperature helium gas can be collected from an area of the lowest available temperature (close to 4' K) inside reservoir 1, and an end of pipe 9*c* that supplies refrigerated helium gas, cooled down to 40' K with the refrigerator, to reservoir 1 is opened over insert pipe 11 (the inner upper part of reservoir 1).

The function of the liquid helium circulation system with a construction as above-mentioned is as follow.

The liquid helium pooled inside liquid helium reservoir 1 starts to sublime at a temperature of about 4° K inside the reservoir and keeps cooling the inner space of the refrigerator until the amount of heat absorbed by the gas raises its temperature to room temperature, or about 300 K. The high temperature helium gas of about 300° K is suctioned out with flow-regulating pump 2 via helium gas recovery pipeline installed at the upper part of reservoir 1. The entire helium gas recovered is sent to heat exchanger 6 of small-capacity refrigerator 5, where the helium gas is cooled down to about 40° K. The refrigerated helium is supplied via pipe 9*c* disposed inside the transfer line to the upper part of inside reservoir 1 and cools down efficiently the inner space of reservoir 1 by absorbing, or enthalpy heat until its temperature rises to 300° K. While the lower space inside reservoir 1 is kept at constant 4° K as the liquid helium inside reservoir 1 evaporates, the evaporation is slowed down because the shrouding helium gas of about 40° K as above-mentioned inhibits heat infiltration from above to the liquid helium. In order to raise the cooling performance of reservoir 1, it is desirable to supply refrigerated helium gas cooled down as low as about 40° K to the reservoir.

Also, pipe 9*c* with its opening close to the surface of liquid helium inside reservoir 1 recovers low temperature helium gas of about 10° K which is liquefied with the heat exchanger 7 of small capacity refrigerator 5. The liquefied helium is returned to reservoir 1 via pipe 9*a* inside transfer line 9, and via gas-liquid separator 1*a* if necessary. This method of liquefying low-temperature helium gas of about 10° K using a small capacity refrigerator is instrumental in constantly replenishing the reducing inventory of liquid helium due to evaporation inside the reservoir at a lower energy cost. Moreover, liquefied helium flowing inside transfer line 9 is protected with refrigerated helium gas or low-temperature helium gas also flowing inside the transfer line against high-temperature parts, which helps keep the liquid helium in transit from evaporating. Meanwhile, liquefying helium gas of the lowest available temperature drawn out from inside reservoir 1 helps raise the liquefying efficiency of the refrigerator, making it possible to use a small capacity refrigerator with an ensuing reduction in running cost.

Described above is a transfer line that consists of pipe 9*c* that supplies refrigerated helium gas, cooled down to about 40° K to reservoir 1, pipe 9*b* that transports low-temperature helium gas of about 10° K recovered from reservoir 1 and pipe 9*a* that transports liquefied helium. It is also possible to design pipe 9*c* that supplies refrigerated helium gas to reservoir 1 as an insulated pipe independent from the transfer line.

Aforementioned is an operational system where the entire volume of high-temperature helium gas of about 300° K recovered from reservoir 1 is cooled down to about 40° K, and the refrigerated helium gas is sent to the inner upper part of the reservoir. It is also possible, by operating flow-regulating valve 4*a*, to supply a portion of high-temperature helium gas through the line 20 to primary and secondary heat exchangers 6*a* and 7*a* (different from those aforementioned) of refrigerator 5 for liquefication and to return the liquefied helium to reservoir 1 via aforementioned pipe 9*a*.

As above-mentioned, the liquid helium circulation system according to this invention is designed to perform as follows.

First, the helium gas whose temperature is about 300° K from inside the liquid helium reservoir, and the recovered helium gas is cooled down to about 40° K in its entirety, taking advantage of the first-stage refrigeration cycle of the refrigerator, and the refrigerated helium gas is sent back to the liquid helium reservoir. Second, low-temperature helium gas of about 10° K is recovered through a pipe with its opening close to the surface of liquid helium inside the reservoir. The recovered low-temperature helium gas is supplied to the secondary heat exchangers 7 of the small capacity refrigerator where the helium gas is liquefied, and the liquefied helium is returned to the reservoir to add to the reducing inventory of liquid helium. Owing to these design features, the helium gas of 40° K can cool the liquid helium reservoir because a large quantity of heat is removed as the helium gas is heated up to about 300° K, and the lower space inside the reservoir is kept at about 4° K, which makes the system comparable with conventional systems in terms of cooling effect. Also, the inventory of liquid helium inside the reservoir is reduced as it evaporates. The design feature to recover and liquefy low-temperature helium gas in the vicinity of the surface of liquid helium inside the reservoir and return the liquefied helium into the reservoir helps minimize energy loss in producing liquid helium, paving the way for designing a liquid helium circulation system with high efficiency at a low cost.

Also, the design feature to have helium gas cooled down with the refrigerator or low-temperature helium gas recovered from the reservoir protects the liquid helium liquefied with the refrigerator in transit greatly helping to reduce the volume of the liquid helium lost by evaporation.

Also, while condensing helium gas of about 40° K to produce liquid helium of about 4° K demands a huge amount of energy, the design feature of this invention to condense helium gas of about 10° K helps minimize the liquefying energy, making it possible to use a small capacity refrigerator.

Another type of refrigerator can replace the refrigerator described above. Using a multi-stage refrigerator would make it possible to have helium gas of different temperatures flow at one time. Also, a controller, not shown in the drawing, is activated with signals from a sensor such as level gauge disposed inside the liquid helium reservoir can be included to control the flow-regulating valve used in replenishing the inventory of liquid helium. Also, optional component units, materials etc. are selectable to suit the purpose of the system.

While the system described above uses one small capacity refrigerator for producing liquid helium and refrigerated helium gas, instead, it is possible to use two or more units of smaller capacity refrigerators, each one assigned with a specific function. Furthermore, while the temperature of helium gas supplied to the refrigerator of the system described above for refrigeration is about 40° K this temperature is not binding and helium gas at a variety of temperatures may be used depending upon the purpose of the work.

The application of this invention is diversified without deviating from its spirit as well as its principal features. This description of system performance is nothing but one application, among others, and should not be construed as a one and only application.

Usability of the Invention in Various Industrial Fields

According to this invention the feature of recovering low-temperature helium (about 10° K) by means of a pipe with its opening close to the liquid helium inside the reservoir, liquefying the recovered gas with a small capacity refrigerator and returning the liquefied helium to the reservoir to replenish the inventory of liquid helium, the loss of energy in producing liquid helium can be minimized, paving the way for designing highly efficient liquid helium circulation systems operating at a low running cost.

Additionally, feature also ensures the effective use of the large heat enthalpy required while helium gas of about 40° K is raised to 300° K for cooling the liquid helium circulation system and overcome the prior need of liquefying the entire volume of helium gas with ensuing benefits of saving a large amount of energy and running cost.

Furthermore, the feature to recover and recycle helium in its entirety overcomes the prior method of troublesome helium replenishment and reduces largely the cost involving liquid helium.

Finally, the feature to transport the liquid helium liquefied with the refrigerator without allowing it to contact high-temperature parts prevents it from evaporating while in transit and ensures its stabilized return to the reservoir.

What is claimed is:

1. A liquid helium circulation system for the recovery and recirculation of helium, comprising:

a liquid helium reservoir that contains liquid helium, said reservoir having an upper inside part and a lower inside part;

a first pipeline that receives evaporated helium gas that was heated to a first temperature range inside the liquid helium reservoir and routes said evaporated helium to a refrigerator, wherein said refrigerator cools said evaporated helium gas into refrigerated helium gas and returns said refrigerated helium gas to the upper inside part of said reservoir; and a second pipeline that receives evaporated helium gas that has a second temperature range near a liquid helium surface inside the liquid helium reservoir and routes said evaporated helium having said second temperature range to said refrigerator, wherein said evaporated helium having said second temperature range is liquefied at said refrigerator and said liquefied helium is returned into said reservoir.

2. The liquid helium circulation system of claim 1, wherein the first pipeline and the second pipeline are both inside an insulated pipe, said insulated pipes surrounded by a vacuum layer.

3. The liquid helium circulation system of claim 2, further comprising a third pipeline that supplies liquid helium to said reservoir, wherein said first, second and third pipelines are in a triple-pipe formation, and wherein said third pipeline is centrally located in the triple-pipe, said second pipeline is disposed concentrically around said third pipeline, and said first pipeline is disposed concentrically around both the second pipeline and the third pipeline and is the outermost pipeline.

4. The liquid helium circulation system of claim 2, wherein said first, second and third pipelines are in a triple-pipe formation, and wherein said first, second and third pipelines are disposed substantially parallel to each other.

5. The liquid helium circulation system of claim 3, wherein said first, second and third pipelines each have a surrounding vacuum layer.

6. The liquid helium circulation system of claim 1, wherein each of said first and second pipelines are each insulated pipes surrounded by a vacuum layer.

7. The liquid helium circulation system of claim 6, wherein the liquid helium liquefied by the refrigerator, while being returned to said reservoir, is insulated by the refrigerated helium gas.

8. The liquid helium circulation system of claim 1, wherein some of said helium gas at said first temperature is liquefied by said refrigerator and returned to said reservoir.

9. The liquid helium circulation system of claim 1, wherein said helium gas liquefied by said refrigerator and is returned to said reservoir via a gas-liquid separator.

10. A method for the recovery and recirculation of helium gas from a liquid helium reservoir, comprising the steps of:

collecting evaporated helium gas that was heated to a first temperature range inside the liquid helium reservoir;

routing said evaporated helium to a refrigerator;

cooling said evaporated helium gas into refrigerated helium gas;

returning said refrigerated helium gas to an upper inside part of said reservoir;

collecting evaporated helium gas that has a second temperature range from near a liquid helium surface inside the liquid helium reservoir;

routing said evaporated helium having said second temperature range to said refrigerator;

liquefying said evaporated helium having said second temperature range at said refrigerator; and returning said liquefied helium to said reservoir.

11. The method for the recovery and recirculation of helium gas from a liquid helium reservoir according to claim 10, further comprising the step of protecting said liquid helium being returned to said reservoir with either said refrigerated helium gas or said evaporated helium gas that has a second temperature range from direct contact with higher temperature components.

12. A transfer line comprising:

a first pipeline that transfers liquid helium;

a second pipeline that transfers low-temperature helium gas; and a third pipeline that transfers refrigerated helium gas having a temperature lower than the low-temperature helium gas;

wherein each of said first, second and third pipelines are insulated pipes surrounded by a vacuum layer, and wherein said insulated pipes are disposed within a fourth pipe insulated with a surrounding vacuum layer.

13. A transfer line comprising:

a first pipeline that transfers liquid helium;

a second pipeline that transfers low-temperature helium gas; and a third pipeline that transfers refrigerated helium gas having a temperature greater than the low-temperature helium gas;

wherein each of said first, second and third pipelines are insulated pipes surrounded by a vacuum layer, and wherein said first, second and third pipelines are in a triple-pipe formation; and wherein said first insulated pipeline is centrally located in the triple-pipe, said second insulated pipeline is disposed concentrically around said first insulated pipeline, and said third insulated pipeline is disposed concentrically around both the first insulated pipeline and the second insulated pipeline.

14. The liquid helium circulation system of claim 1, wherein the system further comprises a third pipeline that receives a portion of the evaporated helium gas, which is liquefied, and routes the liquefied helium to the reservoir.

15. The liquid helium circulation system of claim 14, wherein the system further comprises a heat exchanger that liquefies the portion of the evaporated helium gas.

* * * * *